US008127465B2

(12) United States Patent
Byrne et al.

(10) Patent No.: US 8,127,465 B2
(45) Date of Patent: Mar. 6, 2012

(54) VENTED SHOE ASSEMBLY

(75) Inventors: Richard Byrne, Marlboro, MA (US); Jason Jolicoeur, Stoughton, MA (US); James Walsh, Melrose, MA (US)

(73) Assignee: C. & J. Clark America, Inc., Newton Upper Falls, MA (US)

( * ) Notice: Subject to any disclaimer, the term of this patent is extended or adjusted under 35 U.S.C. 154(b) by 37 days.

(21) Appl. No.: 12/834,528

(22) Filed: Jul. 12, 2010

(65) Prior Publication Data

US 2010/0275466 A1 Nov. 4, 2010

Related U.S. Application Data

(62) Division of application No. 11/565,309, filed on Nov. 30, 2006, now Pat. No. 7,793,426.

(51) Int. Cl.
*A43B 7/06* (2006.01)

(52) U.S. Cl. ..... 36/3 R; 36/3 A; 36/3 B

(58) Field of Classification Search ..... 036/3 R, 036/3 A, 3 B, 30 R
See application file for complete search history.

(56) References Cited

U.S. PATENT DOCUMENTS

| | | | | |
|---|---|---|---|---|
| 1,211,542 | A | 1/1917 | Carolin | |
| 1,335,273 | A | 3/1920 | Bruce | |
| 1,938,393 | A | 12/1933 | Kelly | |
| 2,050,337 | A | 8/1936 | Kelly | |
| 2,098,412 | A | 11/1937 | Bovay | |
| 2,239,211 | A | 4/1941 | Wylie | |
| 2,869,253 | A | 1/1959 | Sachs | |
| 3,012,342 | A | 12/1961 | Ramirez | |
| 3,128,566 | A | 4/1964 | Burlison et al. | |
| 4,693,021 | A | 9/1987 | Mazzarolo | |
| 5,086,572 | A | 2/1992 | Lee | |
| 5,220,791 | A | 6/1993 | Bulzomi | |
| 5,353,525 | A | 10/1994 | Grim | |
| 5,400,526 | A | 3/1995 | Sessa | |
| 5,815,949 | A | 10/1998 | Sessa | |
| 5,826,349 | A | 10/1998 | Goss | |
| 5,893,219 | A | 4/1999 | Smith et al. | |
| 6,041,518 | A | 3/2000 | Polycrape | |
| 6,076,282 | A | 6/2000 | Brue' | |
| 6,260,288 | B1 * | 7/2001 | Barthelemy et al. | 36/3 R |
| 6,305,100 | B1 | 10/2001 | Komarnycky et al. | |
| 6,367,166 | B1 * | 4/2002 | Barthelemy et al. | 36/3 R |
| 6,681,500 | B2 * | 1/2004 | Moretti | 36/3 B |
| 6,948,260 | B2 | 9/2005 | Lin et al. | |
| 7,178,266 | B2 | 2/2007 | Deem et al. | |

(Continued)

FOREIGN PATENT DOCUMENTS

| | | |
|---|---|---|
| DE | 20111608 U1 | 9/2001 |

(Continued)

*Primary Examiner* — Marie Patterson
(74) *Attorney, Agent, or Firm* — St. Onge Steward Johnston & Reens LLC

(57) ABSTRACT

A self-ventilating shoe assembly including an upper having an outer layer, a porous middle layer, and an inner layer; and a sole including an outsole; is provided with one or more passageways or chambers connecting between the outsole and the porous middle layer of the upper. One or more external vent openings are in fluid communication with the one or more passageways or chambers. Cooling ambient air is moved by convection and by a pumping action from the external vent openings through the passageways or chambers up through the porous middle layer of the upper, and optionally, the insole, providing cooling and reducing moisture in the cavity containing the wearer's foot.

20 Claims, 6 Drawing Sheets

U.S. PATENT DOCUMENTS

| | | | | |
|---|---|---|---|---|
| 7,793,426 | B2 * | 9/2010 | Byrne et al. | 36/3 R |
| 2002/0170203 | A1 | 11/2002 | Sanner | |
| 2003/0145488 | A1 | 8/2003 | Cardarelli | |
| 2004/0159012 | A1 | 8/2004 | Keidel et al. | |
| 2005/0178023 | A1 | 8/2005 | Hammonds | |
| 2005/0198858 | A1 * | 9/2005 | Hsu | 36/3 A |
| 2005/0241180 | A1 | 11/2005 | Squadroni | |
| 2006/0032082 | A1 | 2/2006 | Lin | |
| 2006/0032083 | A1 | 2/2006 | Lim | |
| 2007/0151121 | A1 * | 7/2007 | Touzov | 36/3 R |
| 2008/0229623 | A1 * | 9/2008 | Ferretti | 36/3 B |

FOREIGN PATENT DOCUMENTS

| | | | |
|---|---|---|---|
| EP | 0350611 | A1 | 1/1990 |
| EP | 0479183 | A2 | 4/1992 |
| FR | 2905053 | A1 | 2/2008 |

* cited by examiner

VENTED SHOE ASSEMBLY

CROSS-REFERENCE TO RELATED APPLICATIONS

This application is a divisional of U.S. patent application Ser. No. 11/565,309, filed on Nov. 30, 2006 now U.S. Pat. No. 7,793,426.

FIELD OF THE INVENTION

The present invention relates to the field of shoe and footwear constructions.

BACKGROUND OF THE INVENTION

Modern footwear is available in a myriad of materials and fabrications. Despite great advances in support, there has been relatively little development in thermal management of footwear. Very few shoes have been designed to provide methods of dissipating heat generated by the foot from inside the shoe. The foot generates heat while walking, running, or even at rest. As heat is generated by the foot, the shoe temperature begins to rise, and the foot begins to perspire. Excessive perspiration around the foot leads to foot and shoe odor among other problems.

Specifically, the heat and perspiration released by the foot causes several problems. A wet and warm shoe interior is uncomfortable for the user to wear. Further, the perspiration released by the foot contains sodium chloride and urea, which can stain or discolor the outer surface of the shoe, degrading the expressive value of the shoe to the wearer. Moreover, the perspiration and heat around the foot creates an ideal environment for fungi and bacteria to thrive. Fungi and bacteria consume dead skin cells, and produce waste that is the source of foot odor. Fungi and bacteria convert the amino acid methionine to methanethiol which has a sulfuric smell. One such bacteria in the foot is brevibacteria, the same bacteria that gives cheeses such as Limburger, Bel Paese, Port du Salut, and Munster their characteristic pungency. As physical activity increases, foot perspiration, bacterial growth, and bacterial waste production all increase, causing odor to intensify. Finally, a warm and moist shoe provides an ideal environment for foot disease, such as Athlete's foot, to thrive.

One approach minimizing the problems stated above is to provide shoe ventilation to transfer heat and moisture away from the foot. The theory behind shoe ventilation is to reduce the interior temperature and humidity of the shoe by transferring heat and foot perspiration generated by the foot away from the interior of the shoe. Since perspiration decreases with decreasing temperature, a decrease in the interior temperature of the shoe decreases the rate of perspiration around the foot. Thus, the goal of shoe ventilation is to maintain an interior shoe temperature as close to the ambient air temperature as possible. By forcing ambient air around the foot and into the shoe cavity, heat and moisture generated by the foot is transferred away from the foot by the circulating air.

Past disclosures have provided footwear systems for ventilating the area under the foot. These systems are directed towards a pumping system in the sole of the shoe that is actuated by foot movement during walking or running. For example a pump draws ambient air into a cavity in the sole of the shoe, circulates the air within the sole, and then expels it through the sole back into the atmosphere. In another variation, the pump expels the air into the interior of the shoe through ports in the sole. While these systems help transfer excess heat away from the bottom of the foot surface they are ineffective because they do not transfer heat away from the top, rear, and sides of the foot. This allows excessive heat and moisture to build up inside the shoe.

It is possible to make a shoe upper out of mesh or another relatively breathable material, however, these constructions are only suitable for certain types of running shoes or water shoes, and are not appropriate for street shoe constructions or office wear.

Some representative examples of conventional footwear ventilation systems are described below.

U.S. Application No. 2006/0032083 to Lim is directed towards a shoe with a ventilation port in the front of the shoe that communicates with the interior of the shoe, thus allowing for a circulation of air into and from the interior of the shoe while a user walks. An elastic pumping device on the heel of the shoe draws ambient air into the shoe from an intake port in the toe of the shoe to a cavity in the sole of the shoe. This air is then expelled into the interior of the shoe through a hole in the insole. However this system is ineffective at providing adequate circulation to transfer heat away from the foot. The system does not remove heat from the sides, rear, and top of the foot. Second, this system does not provide an efficient means for exhausting the contaminated air. While ambient air is forced inside the shoe through holes in the sole, the bottom of the foot, which rests on top of the insole, prevents or reduces air flow to the interior of the shoe.

U.S. Pat. No. 6,076,282 to Brue is directed towards a forced ventilation shoe that increases the efficiency of the actuated pumping system. The midsole and outsole of the shoe have a series of occluding holes that prevent the return of contaminated air from the sole cavity back into the interior shoe cavity. However, this system is ineffective at providing adequate heat transfer away from the foot because it does not remove heat from the sides, rear, and top of the foot. Second, the downward pressure of the foot prevents ambient air from entering the shoe cavity.

U.S. Pat. No. 6,305,100 to Komarnycky et al. discloses a cavity in the sole of the shoe formed by a series of ridges in the outsole and insole. The lateral surfaces of the sole contain valves that facilitate bidirectional air circulation. However, this system is ineffective at providing adequate heat transfer away from the foot because it does not remove heat from the sides, rear, and top of the foot. Second, the downward pressure of the foot prevents ambient air from entering the shoe cavity. Third, this system recirculates contaminated air from the sole cavity back into the interior of the shoe, resulting in increased foot temperature.

U.S. Pat. No. 5,400,526 to Sessa is directed towards a footwear sole with bulbous protrusions and pneumatic ventilation. Sessa discloses a shoe sole with a forced ventilation system. The system exchanges ambient air from the side of the sole, through a cavity and pumping mechanism in the sole, into the cavity of the shoe, underneath the user's foot. Sessa uses bulbous protrusions on the top-side of the insole to prevent air holes from becoming blocked by the downward pressure of the foot. However, this system does not provide adequate heat removal because it does not transfer heat from the sides, rear, and top of the foot.

SUMMARY OF THE INVENTION

Accordingly, it is an object of the present invention to provide a vented shoe assembly which cools the foot by incorporating air ventilation in the upper, transferring heat from the interior of the shoe to the ambient atmosphere.

Another object of the present invention is to provide a vented shoe assembly having the above characteristics and which also incorporates air ventilation in the sole, transferring heat away from the interior of the shoe to the ambient atmosphere.

Still yet another object of the present invention is to provide a vented shoe assembly having the above characteristics and which the air ventilation system in the upper is in fluid communication with the air ventilation system in the sole.

Still yet another object of the present invention is to provide a vented shoe assembly having the above characteristics and which also incorporates a means of circulating the air through the shoe, wherein ambient air is drawn into the sole of the shoe, circulates through the sole and upper, and then is exhausted into the ambient atmosphere.

Still yet another object of the present invention is to provide a means of minimizing the amount of dirt and water that enters the chambers in the sole of the shoe through the external vent openings.

These and other objects of the present are invention are achieved in one embodiment by provision of a ventilated shoe including an upper, with an outer layer, porous middle layer, and inner layer, which is affixed to a shoe sole, including an insole, a resilient midsole, and an outsole. Chambers in the sole of the shoe are connected to the porous middle layer of the upper. Air flows freely through the chambers and the porous middle layer of the upper. This system is in fluid communication with the ambient atmosphere through external vent openings in the sole of the shoes. This system is further in fluid communication with the ambient atmosphere through perforations in the outer layer of the upper on an upper end of the inner layer.

In some embodiments, ambient air is circulated through the interior of the shoe from the sole to the upper. Ambient air is drawn into chambers in the shoe through external vent openings in the sole of the shoe. The air then flows from the chambers through a series of channels to the porous middle layer of the shoe. Finally, the air is exhausted into the atmosphere through a series of perforations in the outer layer of the upper. The flow of ambient air through the shoe transfers heat away from the foot, cooling the foot.

In some embodiments, ambient air is circulated through the interior of the shoe in no specific direction. Ambient air can enter into the chambers through external vent openings in the sole of the shoe. Air can exit the chambers through external vent openings in the sole of the shoe. Ambient air can enter into the porous middle layer of the upper through perforations in the outer layer of the upper. Air can exit the porous middle layer of the upper through perforations in the outer layer of the upper. The porous middle layer of the upper and the chambers are in fluid communication. In some embodiments the porous middle layer and the ambient atmosphere are in direct fluid communication.

In some embodiments air is exchanged between the chambers in the sole and the interior cavity of the shoe through insole cooling ports located in the midsole of the shoe. The insole cooling ports provide a fluid connection between the chambers in the sole and the interior cavity of the shoe. This air is further exchanged between the chambers in the sole, the porous middle layer of the upper, and the ambient environment through external vent openings in the sole of the shoe, perorations in the outer layer of the upper, and the channels connecting the chambers and the porous middle layer of the upper.

In some embodiment the sole includes a porous insole that rests on top of the midsole and allows air to flow from between the insole cooling ports and the interior of the shoe.

In some embodiments the wearer actuates the air flow within the shoe through the movement of her foot, for example, during walking or running. As the foot lifts the shoe off the ground during the upstep, the chamber in the sole expands, drawing ambient air into the chamber through the external vent openings. As the foot compresses the shoe against the ground during the downstep, the midsole compresses toward the outsole causing the external vent openings to at least partially close and further reducing the size of the chambers, forcing air from the chambers through into the porous middle layer of the upper and into the interior of the shoe.

In some embodiments the chambers in the sole extend laterally from the external vent openings on the side of the sole toward the center of the sole. Channels, fluidly connected to the chambers, extend upwardly to the midsole, then extend laterally, though the midsole, where they are fluidly connected to the porous middle layer of the shoe upper.

In some embodiments the channels that extend to the porous middle layer of the upper are in part defined by an insole resting on top of the channels.

In some embodiments the outsole includes a first outsole and a second outsole. The first outsole and the second outsole define the external vent openings. The first outsole and the second outsole further define chambers within the sole of the shoe that extend towards the center of the shoe. The chambers extend towards the center of the shoe from the external vent openings at an angle above horizontal. This configuration prevents water and dirt from accumulating in the chambers.

The invention and its particular features and advantages will become more apparent from the following detailed description considered with reference to the accompanying drawings.

DETAILED DESCRIPTION OF THE DRAWINGS

Figure 1:
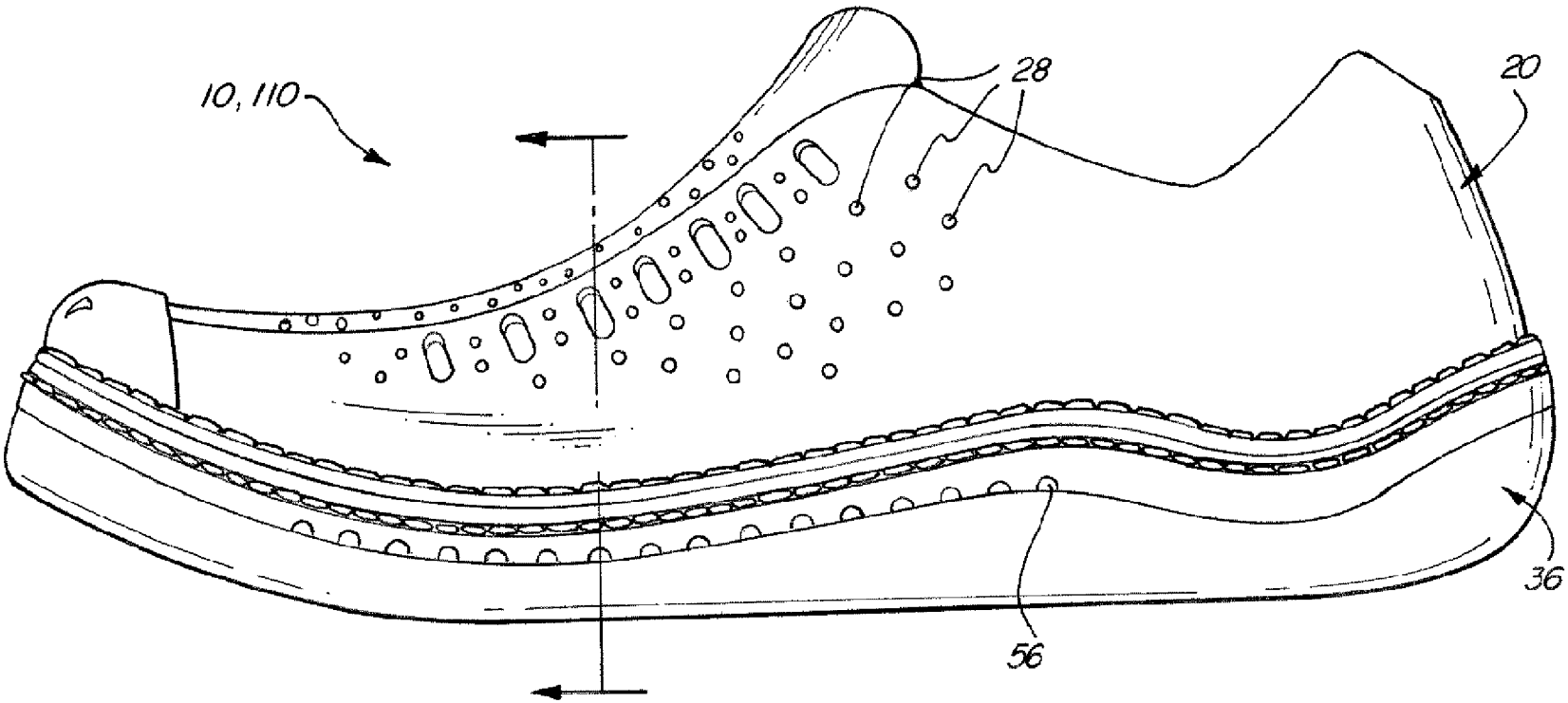
FIG. 1 is a side view of an embodiment of a vented shoe assembly in accordance with one embodiment of the invention, showing the perforations in the outer layer of the upper, and showing the external vent openings in the sole of the shoe.
Figure 2:
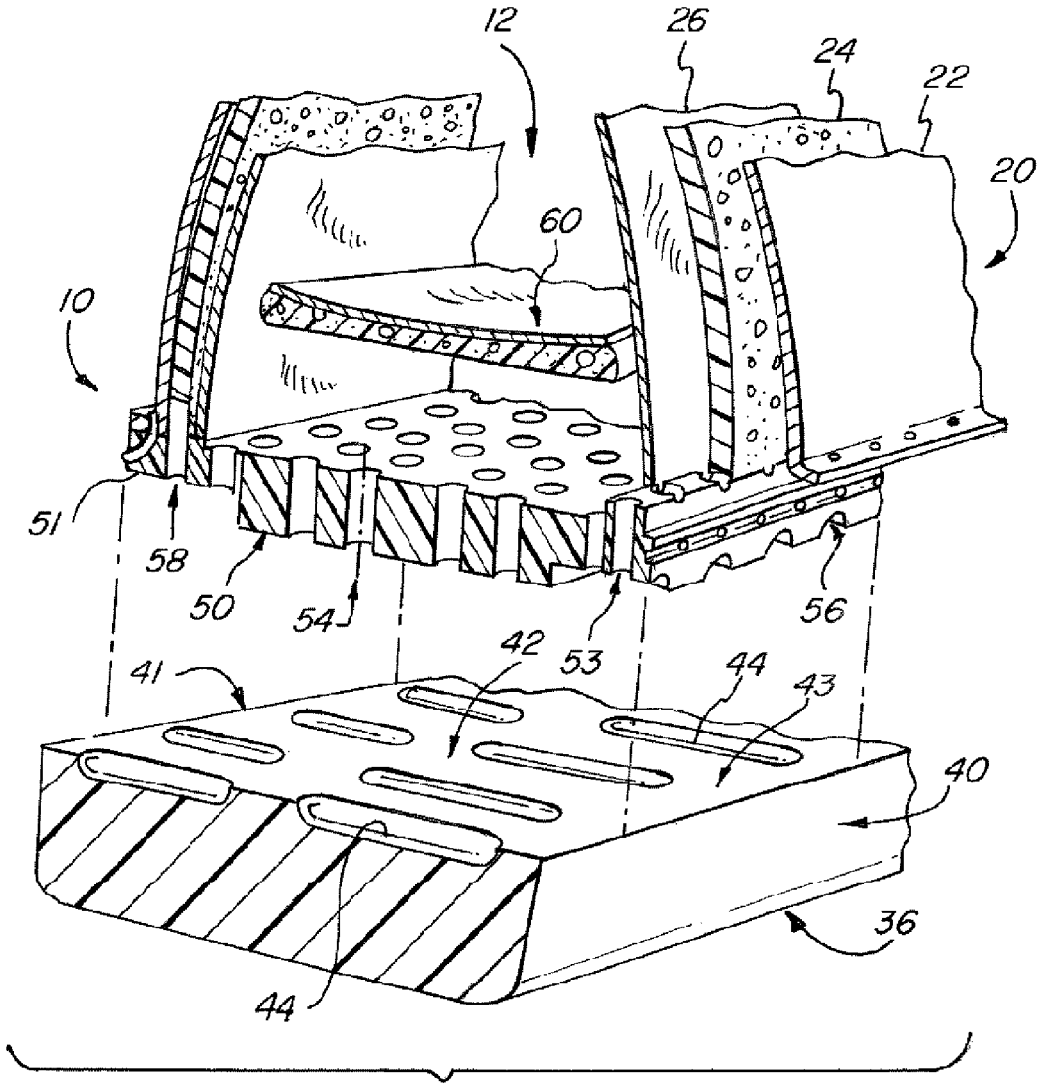
FIG. 2 is a perspective, exploded, cross section view of a vented shoe assembly in accordance with one embodiment of the invention.

Referring to FIGS. 1-4, a vented shoe assembly 10 in accordance with the present invention is shown. The vented shoe assembly 10 includes an upper 20 and a sole 36. The upper 20 and the sole 36 are positioned together to form the vented shoe assembly 10. Referring to FIG. 2, the upper 20 includes an outer layer 22, a porous middle layer 24, and an inner layer 26. It should be understood that the upper 20 may include a greater or lesser number of layers, and may include additional components, for example shoe laces. Further referring to FIG. 2, the sole 36 includes an outsole 40, a resilient midsole 50, and an insole 60. It should be understood that the sole 36 may include a greater or lesser number of components. For example, referring to FIGS. 5 and 6, the outsole 140 may include a first outsole 147 and a second outsole 148. Or for example, as in FIG. 2, the sole 36 may include only an outsole 40 and a resilient midsole 50. In the embodiment shown in FIGS. 1-4, the upper 20 is positioned on an upper surface 38 of the sole 36 to form a vented shoe assembly 10. The sole 36 and the upper 20 form a ventilation system that vents ambient air through the sole 36 and upper 20, cooling the interior shoe cavity 12.

In the embodiment of the vented shoe assembly 10 shown in FIGS. 1-4, the sole 36 includes an outsole 40 and a resilient midsole 50. Preferably the outsole 40 is constructed of ethyl vinyl acetate foam, also known in the art as EVA or simply acetate. However, the outsole 40 may be constructed from polyurethane, thermo plastic rubber, nitro polyvinyl chloride, latex rubber, leather, or any other material or combination of materials known in the art. Preferably the resilient midsole 50 is constructed of cellulose, sold in the field under the brand name Texon. However, the resilient midsole 50 may be constructed from ethyl vinyl acetate foam, non woven synthetic fiber, phylon, polyurethane, phylite, or any other material or combinations of materials known in the art. The resilient midsole 50 is positioned on an upper surface 42 of the outsole 40, preferably the resilient midsole 50 is affixed to the upper surface 42 of the outsole 40 with an adhesive, stitching, or some other means known in the art to maintain the midsole 50 and outsole 40 in relative proximity.

Referring to the embodiment shown in FIGS. 1-4, chambers 46 are formed in the sole 36 between the outsole 40 and the resilient midsole 50. Preferably, two parallel series of hollow troughs 44 are formed in the upper surface 42 of the outsole 40. It is further preferable that the depth of the troughs 44 is less than that of the outsole 40. In the embodiment shown in FIGS. 1-4 each trough 44 extends from either the left side 41 or right side 43 of the upper surface 42 of the outsole 40 toward the longitudinal centerline of the outsole 40. Preferably the troughs 44 do not extend fully to the longitudinal centerline, but extend to an area proximate to the longitudinal centerline. It is further preferable that the troughs 44 are symmetric across the longitudinal centerline of the outsole 40. It should be understood that the troughs 44 formed in the outsole 40 may be of any number and of any configuration.

Figure 3:
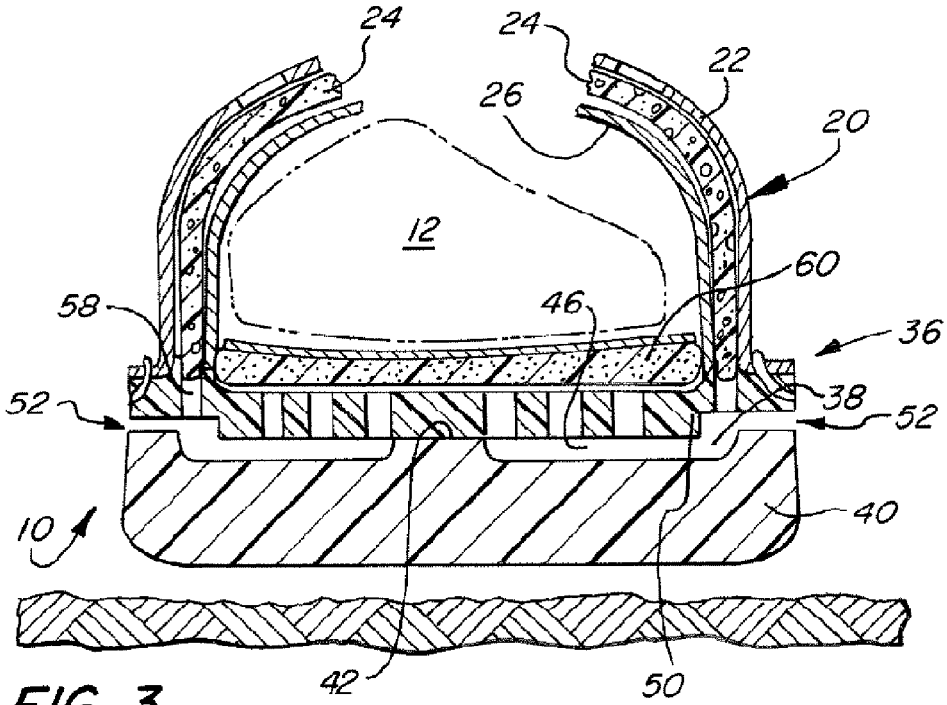
FIG. 3 is a cross section view of the vented shoe assembly of FIG. 2 showing the vented shoe assembly in the upstep position, wherein the chambers in the sole are expanded.
Figure 4:
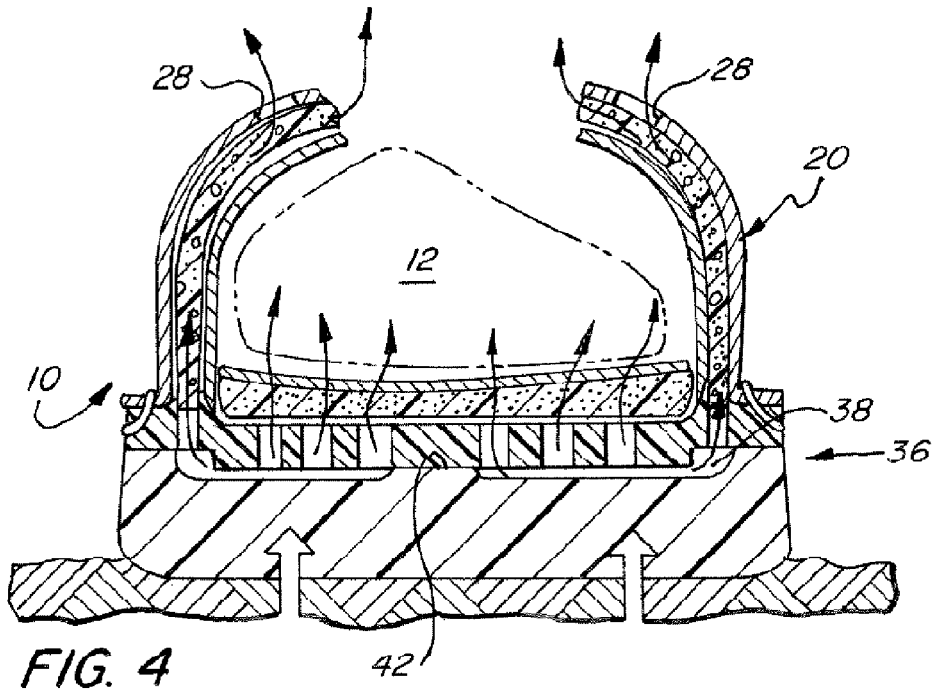
FIG. 4 is a cross section view of the vented shoe assembly of FIG. 3 showing the vented shoe assembly in the downstep position, wherein the chambers in the sole are compressed.

In the embodiment of the vented shoe assembly 10 shown in FIGS. 2-4, the cross section of the resilient midsole 50 is shown. The cross section of the resilient midsole 50 is formed in the shape of a tee. On the left side 51 and right side 53 of the resilient midsole 50, the height of the resilient midsole 50 is less than the height of the resilient midsole 50 at the longitudinal centerline. The left side 51 and the right side 53 of the resilient midsole 50 may for example, form cantilevers that extend outward from the body of the resilient midsole 50. It is preferable that the base of the tee is substantially wider than the combined width of the cantilevers.

Referring to FIGS. 3 and 4, an embodiment of the vented shoe assembly 10 is shown. The resilient midsole 50 is positioned on the upper surface 42 of the outsole 40, preferably the resilient midsole 50 is affixed to the upper surface 42 of the outsole 40 with an adhesive, stitching, or some other means known in the art to maintain the resilient midsole 50 and outsole 40 in relative proximity. Chambers 46 are formed in the sole 36 between the outsole 40 and resilient midsole 50. Preferably, the troughs 44 in the outsole 40 and the lower surface 55 of the resilient midsole 50 define the chambers 46. The chambers 46 are preferably further defined by the cantilevered left side 51 and cantilevered right side 53 of the resilient midsole 50. It should be understood that the chambers 46 may be formed by the outsole 40 and resilient midsole 50 in any numbers of sizes and configurations. It should further be understood that the chambers 46 can be formed entirely by the outsole 40, or the chambers 46 can be formed entirely by the resilient midsole 50.

In the embodiment shown in FIGS. 1-4, the chambers 46 in the sole 36 fluidly communicate with the ambient atmosphere 5 through a series of external vent openings 52 in the sole 36. In this embodiment the external vent openings 52 are formed around the perimeter of the sole 36 between the cantilevered left side 51 of the resilient midsole 50 and the left side 41 of the outsole 40 and between the cantilevered right side 53 of the resilient midsole 50 and right side 43 of the outsole 40. Further, in this embodiment, semicircular openings 56 are formed in the cantilevered left side 51 of the resilient midsole 50 and in the cantilevered right side 53 of the resilient midsole 50. It should be understood that the sole 36 may include any number of external vent openings 52. It should further be understood that the external vent openings 52 make take any form.

In the embodiment shown in FIGS. 1-4 the upper 20 includes an outer layer 22, a porous middle layer 24, and an inner layer 26. Preferably the outer layer 22 is constructed from leather. However, the outer layer 22 may be constructed from canvas, synthetic leather, EVA, denim, wool, felt, or any other material or combination of materials known in the art. Preferably the porous middle layer 24 is constructed from a porous material through which air can pass with little or no resistance. Preferably the porous middle layer 24 is constructed from a synthetic mesh. However, the porous middle layer 24 may be constructed from any material or combination of materials through which air can pass with little or no resistance. In some embodiments, it is preferable that the porous middle layer 24 of the upper 20 consists of a layer of air between the outer layer 22 and the inner layer 26. Preferably the inner layer 26 is constructed from a soft lining, such as lamb lining. However, the inner layer 26 may be constructed from any other material or combination of materials known in the art. The outer layer 22, porous middle layer 24, and inner layer 26 are positioned together to form a shoe upper 20. The design and configuration of a shoe upper 20 is already known in the art.

Further referring to the vented shoe assembly 10 shown in FIGS. 1-4 the inner layer 26 is adjacent to the interior cavity of the shoe 12. The outer layer 22 is adjacent to the ambient atmosphere 5. The porous middle layer 24 is between the outer layer 22 and the inner layer 26. The layers 22, 24, 26 may be positioned together by any means known in the art. Preferably the layers 22, 24, 26 are stitched together to form an upper 20. Preferably the stitching allows air to pass through the porous middle layer 24 with little or no resistance. In some embodiments, for example when the porous middle layer 24 consists of air, the outer layer 22 and inner layer 26 can be stitched together, however enough space is left between the outer layer 22 and the inner layer 26 to allow air to pass between the outer layer 22 and the inner layer 26 with little or no resistance. In some embodiments the layers 22, 24, 26 are positioned together with adhesive, snaps, or hook and loop fasteners. However, the layers 22, 24, 26 may be positioned together with any means known in the art.

In the embodiment shown in FIGS. 1-4, the upper 20 is positioned on an upper surface 38 of the sole 36. Preferably the upper 20 is affixed to the sole 36. In the embodiment shown in FIGS. 1-4, the upper 20 is stitched directly to the sole 36. It is preferable that the upper 20 is attached directly to the sole 36 using an opanka stitch. However, the upper 20 may be affixed to the sole 36 by an adhesive, fastener, or any other means known in the art.

In the embodiment shown in FIGS. 1-4, the chambers 46 are in fluid communication with the porous middle layer 24 of the upper 20. Preferably channels 58 are formed in the resilient midsole 50 to provide a fluid communication between the chambers 46 and the porous middle layer 24 of the upper 20. In the embodiment shown in FIGS. 1-4, the channels 58 are a series of vertical holes located on the perimeter of the resilient midsole 50. Preferably the channels 58 are located in the cantilevered left side 51 and cantilevered right side 53 of the resilient midsole 50. However, the channels 58 can be in any location as long as the channels 58 form a fluid communication between the chambers 46 and porous middle layer 24 of the upper 20. It should be understood that although channels 58 are the preferred means to connect the chambers 46 with the porous middle layer 24, any means may be used to provide a fluid communication between the chambers 46 and the porous middle layer 24, for example the chambers 46 and the porous middle layer 24 can be directly linked.

In the embodiment shown in FIGS. 1-4 the chambers 46 are also in fluid communication with the interior of the shoe cavity 12 through a series of insole cooling ports 54. Preferably the insole cooling ports 54 comprise a series of vertical holes passing through the resilient midsole 50. The insole cooling ports 54 are preferably vertically in line with chambers 46. For example, an insole cooling port 54 is located directly above each chamber 46. In some embodiments, such as that shown in FIGS. 1-4, a porous insole 60 is positioned on an upper surface 57 of the resilient midsole 50. The porous insole 60 is placed above the insole cooling ports 54, and preferably above a substantial portion of the resilient midsole 50. Preferably the porous insole 60 is constructed from foam sold in the field under the brand name Ortholite. However, the porous insole 60 may be constructed from any material or combination of materials known in the art. In the embodiment shown in FIGS. 1-4 it is preferable that the porous insole 60 is stitched to the inner layer 26 of the upper 20, for example using strobel stitch. However, the porous insole 60 may be attached to the upper 20 with any means known in the art. It should be understood the porous insole 60 can be positioned relative to and not attached to either the upper 20 or the sole 36. It should be further understood that the ventilated shoe assembly 10 may include a nonporous insole, or not include an insole at all.

In the embodiment in FIGS. 1-4, perforations 28 in the outer layer 22 of the upper 20 provide a fluid communication between the porous middle layer 24 and the ambient atmosphere 5. Small perforations 28 are preferable, for example perforations 28 having a diameter less than a quarter of an inch (¼") because smaller perforations 28 limit the amount of moisture and dirt that can enter the porous middle layer 24, while still maintaining a sufficient fluid connection to provide proper ventilation of the shoe. It should be understood that the vented shoe assembly 10 can function without perforations 28 in the outer layer 22. It should be further understood that the vented shoe assembly 10 can have any number of perforations 28, that the perforations 28 can be of any size, and that the diameter of the perforations 28 need not be uniform. It should further be understood that in some embodiments of the vented shoe assembly 10 the porous middle layer 24 is in direct fluid communication with the ambient atmosphere 5 at the top of the upper 20, or through the inner layer 26.

FIGS. 3 and 4 further show an embodiment of the vented shoe assembly 10 wherein the upstep/downstep motion of the foot creates a pumping action in the vented shoe assembly 10. The pumping action generates an air flow through the vented shoe assembly 10, drawing ambient air into the vented shoe assembly 10, circulating the air through the vented shoe assembly 10, and then expelling the air back into the ambient atmosphere 5. FIGS. 3 and 4 show a cross section view of one embodiment of the vented shoe assembly 10. In FIG. 3 the vented shoe assembly 10 is shown in the upstep position. In the upstep position the sole 36 does not contact the ground 9. When the vented shoe assembly 10 is in the upstep, the chambers 46 are preferably fully expanded. Further, the external vent openings 52 in the side of the sole 36 are fully open.

In FIG. 4, the vented shoe assembly 10 is shown in the downstep position. As the sole 36 is pressed on the ground, for instance during the downstep while walking or running, the force of the user's foot compresses the resilient midsole 50 towards the outsole 40. The cantilevered left side 51 and cantilevered right side 53 of the resilient midsole 50 are compressed towards the outsole 40, partially closing the external vent openings 52, and partially reducing the volume of the chambers 46. It is preferable that the compression of the foot fully closes the external vent openings 52. As the resilient midsole 50 is compressed towards the outsole 40, the volume of each chamber 46 is reduced. The reduced volume of the chambers 46 causes the internal air pressure of each chamber 46 to increase. Preferably, the increased air pressure forces air from the chambers 46 through the insole cooling ports 54, and into the interior of the shoe 12. Further, the increased pressure forces air from the chambers 46 through the channels 58, and into the porous middle layer 24 of the upper 20. The air that flows into the interior of the shoe cavity 12 preferably circulates around the foot, and then exits the interior shoe cavity 12 through the foot opening in the upper 20. The air that flows into the porous middle layer 24 of the upper 20 preferably circulates in the porous middle layer 24 of the upper 20, and then exits the porous middle layer 24 through the perforations 28 in the outer layer of the upper 22.

As the vented shoe assembly 10 is lifted off the ground as shown in FIG. 3, the force compressing the resilient midsole and the outsole decreases to zero, causing the outsole 40 and the resilient midsole 50 to separate, further causing the volume of the chambers 46 to expand, and the external vent openings 52 to open. The volume expansion of the chambers 46 reduces the pressure within the chambers 46, causing ambient air to be drawn into the chambers 46 through the external vent openings 52. Preferably, the upstep/downstep cycle continues to pump fresh air through the vented shoe assembly 10 as long as the cycle continues.

The ambient air that is drawn through the vented shoe assembly 10 is preferably lower in temperature than the temperature of the interior of the shoe cavity 12. As the air is drawn through the vented shoe assembly 10, energy from the foot, in the form of heat, is transferred from the higher temperature foot to the lower temperature air through conduction and convection. As energy is transferred away from the foot, the interior shoe 12 temperature is reduced.

In one embodiment of the present invention, air moves through the vented shoe assembly 10 by convection. As energy is transferred in the form of heat from the interior shoe cavity 12 to the air inside the chambers 46 and the air inside the porous middle layer 24 of the upper 20, the temperature of the air increases. The temperature increase of the air preferably increases the buoyancy of the air causing it to rise from the chambers 46 through the channels 58 and into the porous middle layer 24 of the upper 20. Further, the air in the porous middle layer 24 rises out of the porous middle layer 24 through the perforations 28 in the outer layer of the upper 20. As a result of the pressure difference created by the warm air, denser ambient air is drawn from the ambient atmosphere 5 into the chambers 46 through the external vent openings 52. It should be understood the air flow created by convection may occur in a ventilated shoe assembly 10 in which the air is pumped by a mechanical force, such a walking, or the convection may occur on its own, for example in a rigid sole assembly.

It should be understood that the embodiment of the vented shoe assembly 10 shown in FIGS. 1, 2, 3, and 4, is only one of many embodiments of the disclosure. The vented shoe assembly 10 may circulate air in the reverse direction. Further, the vented shoe assembly 10 may not have perforations 28 in the outer layer 22 of the upper 20 to exhaust the air from the porous middle layer 24. Many different embodiments of the vented shoe assembly 10 are possible.

Figure 5:
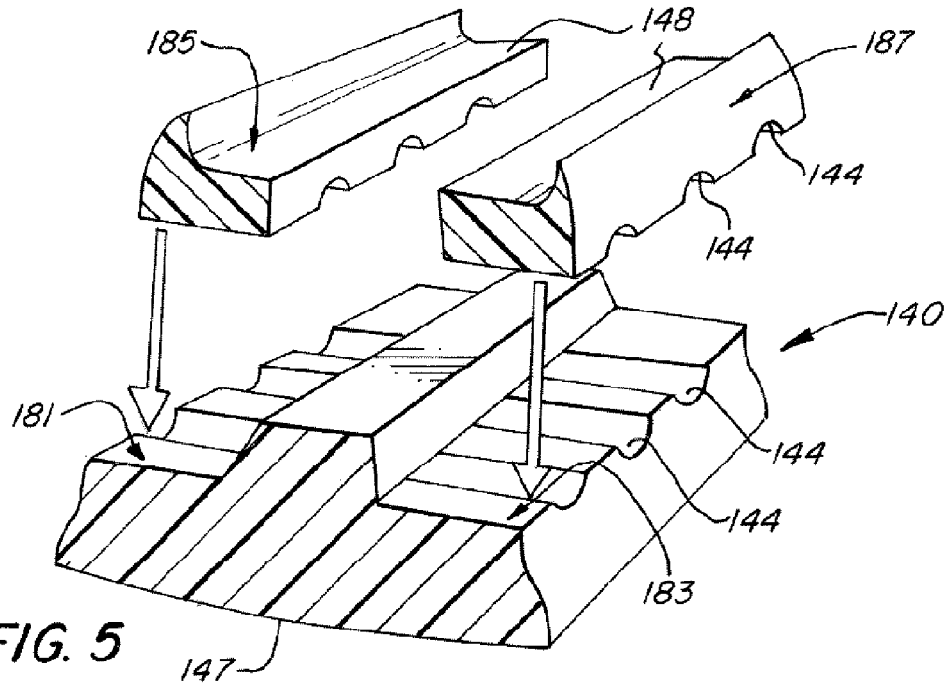
FIG. 5 is a perspective, exploded, cross section view of a vented shoe assembly in accordance with a second embodiment of the invention, wherein in the outsole includes a first outsole and a second outsole.
Figure 6:
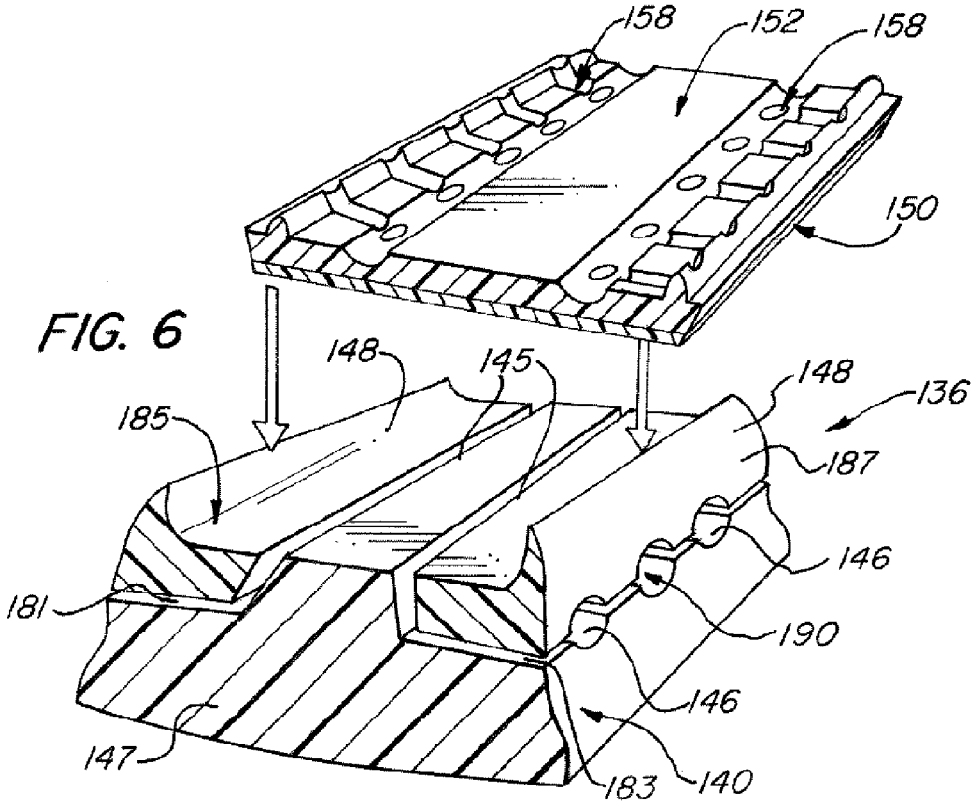
FIG. 6 is a perspective, exploded, cross section view of the vented shoe assembly of FIG. 5 with an additional midsole.
Figure 7:
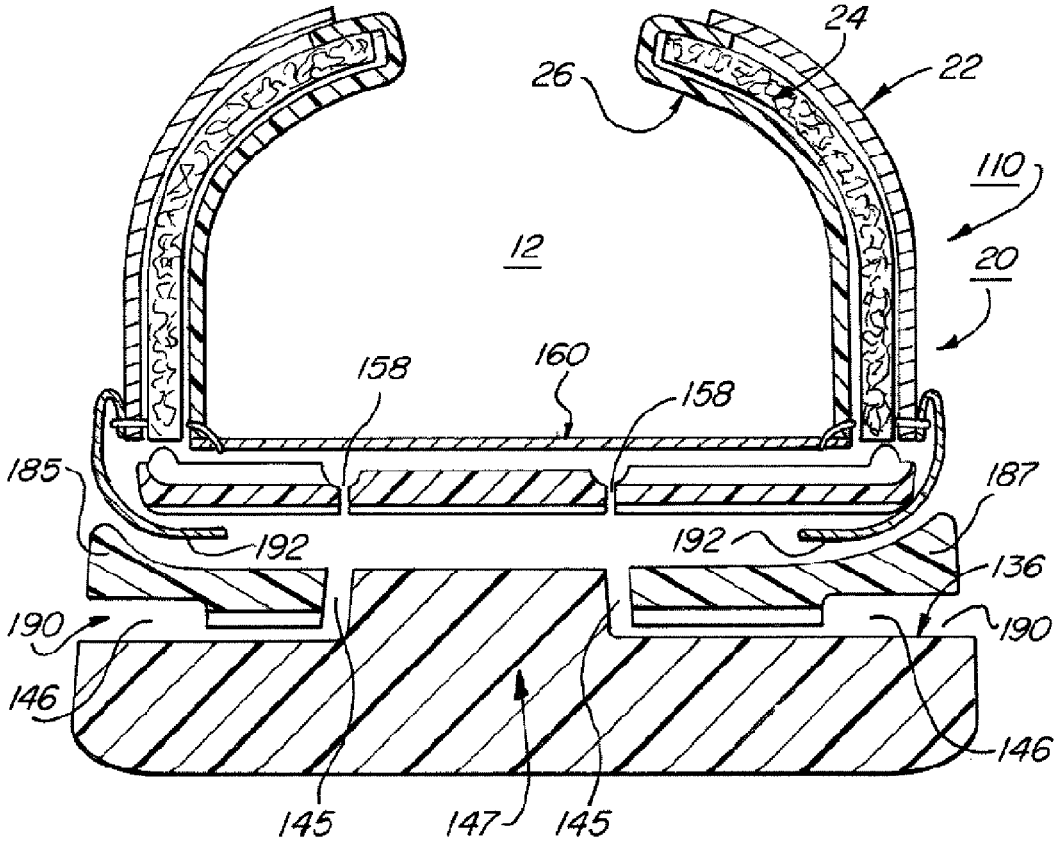
FIG. 7 is a cross section view of the vented shoe assembly of FIG. 6.

A second embodiment of the vented shoe assembly 110 is shown in FIGS. 5-7. The vented shoe assembly 110 includes an upper 20 and a sole 136. The upper 20 and the sole 136 are positioned together to form the vented shoe assembly 110. Referring to FIG. 6, the sole 136 includes a first outsole 147, a second outsole 148, a resilient midsole 150, and an insole 160. In the embodiment shown in FIGS. 5-7, the upper 20 is positioned on an upper surface 138 of the sole 136 to form a vented shoe assembly 110. The sole 136 and the upper 20 form a ventilated sole assembly 110 that draws fresh air through the sole 136 and upper 20, cooling the interior shoe cavity 12.

In the embodiment of the vented shoe assembly 110 shown in FIGS. 5-7, the outsole 140 includes a first outsole 147 and a second outsole 148. Preferably the outsole 140 is constructed of ethyl vinyl acetate foam, also known in the art as EVA or simply acetate. However, the outsole 140 may be constructed from polyurethane, thermo plastic rubber, nitro polyvinyl chloride, latex rubber, leather, or any other material or combination of materials known in the art. In the embodiment shown in FIG. 5 the cross section of the first outsole 147 is formed in the shape of an inverted tee. The left side 181 and the right side 183 of the first outsole 147 form the handlebars of the inverted down tee. The height of the left side 181 and the right side 183 of the first outsole 147 is substantially less than that of the center area of the first outsole 147. In the embodiment shown in FIG. 5, the upper surface of the left side 181 and the upper surface of the right side 181 include a series of hollow troughs 144 extending from the edge of the left side 181 and the edge of the right side 183, toward the longitudinal centerline of first outsole 147.

Referring to the embodiment shown in FIGS. 5-7, the second outsole 148 includes a left second outsole 185 and a right second outsole 187. It should be understood that the second outsole 147 may include only one component in the form of an oval ring. In the oval ring embodiment, the left second outsole 185 and the right second outsole 187 correspond to the left and right sides of the oval. Referring to the embodiment shown in FIGS. 5-7, the left second outsole 185 is placed on the upper surface of the left side 181 of the first outsole 147. The right second outsole 187 is placed on the upper surface of the right side 183 of the first outsole 147. Preferably the lower surface of the left second outsole 185 and the lower surface of the right second outsoles 187 have a series of hollow troughs 144 that correspond with the series of hollow troughs 144 on the upper surface of the left side 181 and the right side 183 of the first outsole 147.

Referring to the embodiment shown in FIG. 6, chambers 146 are formed in the outsole 140 between the first outsole 147 and the second outsole 148. Preferably, two parallel series of tubular chambers 146 are formed by the positioning of the left second outsole 185 on the left side 181 of the first outsole 147, and the right second outsole 187 on the right side 183 of the first outsole 147. In the embodiment shown in FIGS. 5-7 each chamber extends from either the left side or right edge of the outsole 140 toward the longitudinal centerline of the outsole 140. Preferably the chambers 146 are symmetric across the longitudinal centerline of the outsole 140. It should be understood that the chambers 146 formed in the outsole 140 may be of any number and of any configuration.

Further referring to the chambers 146 in the embodiment shown in FIGS. 5-7, it is preferred that the chambers 146 are at an angle above the horizontal as the chambers 146 extend from the either the left or right side of the outsole 140 to the longitudinal centerline of the outsole 140. For example the bottom of the chamber 146 at the side of the outsole 140 is lower than the bottom of the chamber 146 proximate to the longitudinal centerline. The angle of the chambers 146 disclosed in the embodiment shown in FIGS. 5-7 prevents water and debris from collecting inside the chambers 146. If water or debris enters the chambers 146 in the embodiment shown the force of gravity forces the water or debris downward toward the exit of the chambers 146. Further referring the embodiment of the outsole 140 in FIGS. 5-7, specifically to the position of the left second outsole 185 on the left side 151 of the first outsole 147 and the right second outsole 187 on the right side 153 of the first outsole 1478, it is preferable that a vertical gap 145 exists between the center portion of the first outsole 147 and the left second outsole 185, and that a vertical gap 145 exists between the center portion of the first outsole 147 and the right second outsole 187. It should be understood that the chamber 146 will include or connect with the gap 145.

In the embodiment shown in FIGS. 5-7, the chambers 146 in the outsole 140 communicate with the ambient atmosphere through one or more external vent openings 190 in the outsole 140. In this embodiment the external vent openings 190 are formed around the perimeter of the outsole 140 between the left side 181 of the first outsole 147 and the left second outsole 185 and between right side 183 of the first outsole 147 and right second outsole 187. Preferably there is one external vent opening 190 for each chamber 146. It should be understood that the external vent openings 190 make take any form.

Further referring to the embodiment of the vented shoe assembly 110 shown in FIGS. 5-7, the sole 136 includes an insole 160, a resilient midsole 150, and an outsole 140. The resilient midsole 150 is placed on an upper surface 142 of the outsole 140, preferably the resilient midsole 150 is affixed to the upper surface 142 of the outsole 140 with an adhesive or some other means known in the art to maintain the midsole 150 and outsole 140 in relative proximity. Referring to the resilient midsole 150 shown in the embodiment in FIGS. 6-7 a series of channels 158 are formed in the upper surface of the resilient midsole 150. Preferably, the channels 158 extend from an area proximate to the longitudinal centerline of the upper surface 152 of the midsole 150 to the perimeter of the upper surface of the resilient midsole 150. In the embodiment shown, the tops of the channels 158 are open. The channels 158 formed in the upper surface of the resilient midsole 150 are fluidly connected to the chambers 146 in the outsole 140. Preferably the channels 158 extend to the chambers 146 through a series of vertical holes proximate to the longitudinal centerline of the midsole 140. It is preferable that one vertical hole corresponds to each chamber 146.

Further referring to the embodiment of sole 136 shown in FIGS. 5-7 an insole 160 is positioned on an upper surface of the midsole 150. The lower surface of the insole 160 provides an upper surface for the channels 158. Preferably the insole 160 is constructed from foam sold in the field under the brand name Ortholite. However, the insole 160 may be constructed from any other material or combination of materials known in the art. In the embodiment shown in FIGS. 5-7, the insole 160 is porous so that air may pass through the insole 160. In the embodiment shown in FIGS. 5-7 the insole 160 is stitched to the inner layer of the upper 46, for example using a strobel stitch. In the embodiment shown in FIGS. 5-7 the channels 158 are in fluid communication with the interior of the shoe cavity 12 through the porous midsole 160.

In the embodiment shown in FIGS. 5-7 the upper 20 includes an outer layer 22, a porous middle layer 24, and an inner layer 26. Preferably the outer layer 22 is constructed from leather. However, the outer layer 22 may be constructed from canvas, synthetic leather, EVA, denim, wool, felt, or any other material or combination of materials known in the art. The porous middle layer 24 is constructed from a material through which air can pass with little or no resistance. Preferably the porous middle layer 24 is constructed from a synthetic mesh. However, the porous middle layer 24 may be constructed from any material or combination of materials through which air can pass with little or no resistance. In some embodiments, it is preferable that the porous middle layer 24 of the upper 20 consists only of a cavity of air, formed between the outer layer 22 and the inner layer 26. Preferably the inner layer 26 is constructed from a soft lining, such as lamb lining. However, the inner layer 26 may be constructed from any other material or combination of materials known in the art. The outer layer 22, porous middle layer 24, and inner layer 26 are positioned together to form an upper 20. The design and configuration of an upper 20 is already known in the art.

Further referring to the vented shoe assembly 110 shown in FIGS. 5-7 the inner layer 26 is adjacent to the interior cavity 12 of the shoe. The outer layer 22 is adjacent to the ambient atmosphere. The porous middle layer 24 is between the outer layer 22 and the inner layer 26. The layers 22, 24, 26 may be positioned together by any means known in the art. Preferably the layers 22, 24, 26 are stitched together to form the upper 20. In some embodiments, the outer layer 22 and inner layer 26 can be stitched together, however enough space must be left between the outer layer 22 and the inner layer 26 to allow air to pass between the layers with little or no resistance. In some embodiments the layers 22, 24, 26 are positioned together with adhesive, snaps, or hook and loop fasteners. However, the layers 22, 24, 26 may be positioned together with any means known in the art.

In the embodiment shown in FIGS. 5-7, the upper 20 is positioned on an upper surface 138 of the sole 136. Preferably the upper 20 is affixed to the sole 136. In the embodiment shown in FIGS. 5-7, the upper 20 is stitched directly to the sole 136 of the vented shoe assembly 110. However, the upper 20 may be affixed to the sole 136 by an adhesive, fastener, or any other means known in the art. The chambers 146 are in fluid communication with the porous middle layer 24 of the upper 20. Preferably, the channels 158 formed by the midsole 150 and the insole 160 provide a fluid communication between the chambers 146 and the porous middle layer 24 of the upper 20. The channels 158 can be in any location as to form a fluid communication between the chambers 146 and porous middle layer 24 of the upper 20. It should be understood that although channels 158 are the preferred means to connect the chambers 146 with the porous middle layer 24, any means may be used to provide a fluid communication between the chambers 146 and the porous middle layer 24, for example the chambers 146 and the porous middle layer 24 can be linked directly.

In the embodiment in FIGS. 5-7, perforations 28 in the outer layer 22 of the upper 20 provide a fluid communication between the porous middle layer 24 and the ambient atmosphere. Small perforations 28 are preferable, for example perforations having a diameter less than a quarter of an inch (¼") because smaller perforations 28 limit the amount of moisture that can enter the porous middle layer 24 of the upper 20, while still maintaining a fluid connection sufficient to allow for the proper ventilation of the ventilated shoe assembly 110. It should be understood that the vented shoe assembly 110 can function without perforations 28 in the outer layer 22. It should be further understood that the vented shoe assembly 110 can have any number of perforations 28, that the perforations 28 can be of any size, and that the diameter of the perforations 28 need not be uniform. It should further be understood that in some embodiments of the vented shoe assembly 10 the porous middle layer 24 is in direct fluid communication with the ambient atmosphere 5 at the top of the upper 20.

FIG. 7 shows a cross section of an embodiment of the vented shoe assembly 110 as shown in FIGS. 5-6. Upper 20 is secured to the outsole 140 by flange pieces 192 which are adhered to the left and right second outsoles 185 and 187. Ambient air is circulated through the vented shoe assembly 110 by a pumping action, preferably driven by the upstep/downstep motion of the foot. The pumping action generates an air flow through the vented shoe assembly 110, drawing ambient air into the vented shoe assembly 110, circulating the air through the vented shoe assembly 110, and then expelling the air back into the ambient atmosphere 5. FIG. 7 shows the cross section of one embodiment of the vented shoe assembly 110. When the shoe is in the upstep, the chambers 146 are preferably fully open. Further, the external vent openings 152 are fully open. Further, it preferable the channels 158 formed by the midsole 150 and the insole 160 are fully expanded.

When the vented shoe assembly 110 is in the downstep position the sole 136 is pressed on the ground 9, for example during the downstep during walking or running. The force of the user's foot on the sole 136 compresses the midsole 150 towards the outsole 140. The force of the user's foot further compresses the first outsole 147 to the second outsole 148. Preferably the compression reduces the size of the chambers 146 and the channels 158. Preferably the compression closes the external vent openings 190. The reduced volume of the chambers 146 and the channels 158 preferably causes the air pressure to increase inside the chambers 146 and the channels 158. Preferably, the increased pressure forces air from the chambers 146 through the external vent openings 190 and into the ambient atmosphere 5. Further, it is preferable that the increased pressure forces air from the channels 158 into the porous middle layer 24 of the upper 20. The air that flows into the porous middle layer 24 of the upper 20 preferably circulates in the porous middle layer 24 of the upper 20, and then exits the porous middle layer 24 through the perforations 28 in the outer layer 22 of the upper 20.

As the embodiment of the vented shoe assembly 110 shown is FIG. 7 is lifted off the ground 9 the force compressing the resilient midsole 150 toward the outsole 140 decreases to zero, causing the outsole 140 and the resilient midsole 150 to separate, causing the volume of the chambers 146 to expand and the volume of the channels 158 to expand. The volume expansion of the chambers 146 reduces the pressure within the chambers 146, causing ambient air from the ambient atmosphere 5 to be drawn into the chambers 146 through the external vent openings 190. Further, the volume expansion of the channels 158 decreases the air pressure within the channels 158, causing ambient air to be drawn from the ambient atmosphere 5 into the porous middle layer 24 of the upper 20, and preferably further drawn from the porous middle layer 24 of the upper 20 into the channels 158.

The ambient air drawn through the vented shoe assembly 110 is preferably lower in temperature than the temperature of the interior of the shoe cavity 12. As the air is drawn through the venting system in the shoe, energy from the foot, in the form of heat, is transferred from the higher temperature foot to the lower temperature air through conduction and convection. As energy is transferred away from the foot, the interior shoe 12 temperature is reduced. As energy is transferred to the air within the vented shoe assembly 110, the temperature of the air increases. Preferably warm air is exhausted from the shoe, and cooler, ambient air is drawn through into the vented shoe assembly 110.

In one embodiment of the present invention, air if forced through the vented shoe assembly 110 through convection, As energy is transferred in the form of heat from the interior shoe cavity 12 to the air inside the chambers 146 and the air inside the porous middle layer 24 of the upper 20 the temperature of the air increases. The temperature increase of the air preferably increases the buoyancy of the air causing it to rise from the chambers 146 through the channels 158 and into the porous middle layer 24 of the upper 20. Further, the air in the porous middle layer 24 rises out of the porous middle layer 24 through the perforations 28 in the outer layer 22 of the upper 24. As a result of the pressure difference created by the buoyant air, denser ambient air is drawn from the ambient atmosphere 5 into the chambers 146 through the external vent openings 190. It should be understood the air flow created by convection may exists in a system in which the air is pumped by a mechanical force, such a walking, or the convection system can exists on its own, for example in a rigid sole assembly.

It should be understood that the embodiment of the vented shoe assembly 110 shown in FIGS. 5-7 is one embodiment of the present disclosure. The vented shoe assembly 110 may have air that circulates in the reverse direction or air flow that circulates in both directions. Further, the vented shoe assembly 110 may not have perforations 28 in the outer layer 22 of the upper 20 to expel the air from the shoe. Rather, the porous middle layer 24 may vent air directly to the ambient atmosphere 5 through the top of the upper 20. Many different embodiments of the vented shoe assembly are possible.

Figure 8:
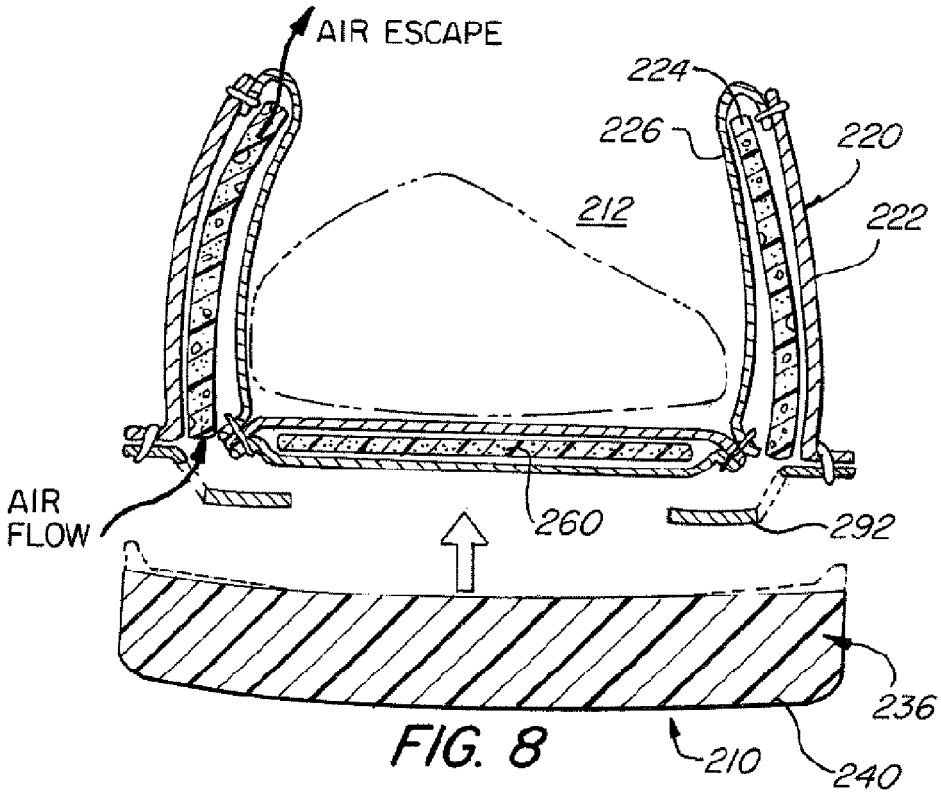
FIG. 8 is a cross section exploded view of a vented shoe assembly in accordance with a third embodiment of the invention.
Figure 9:
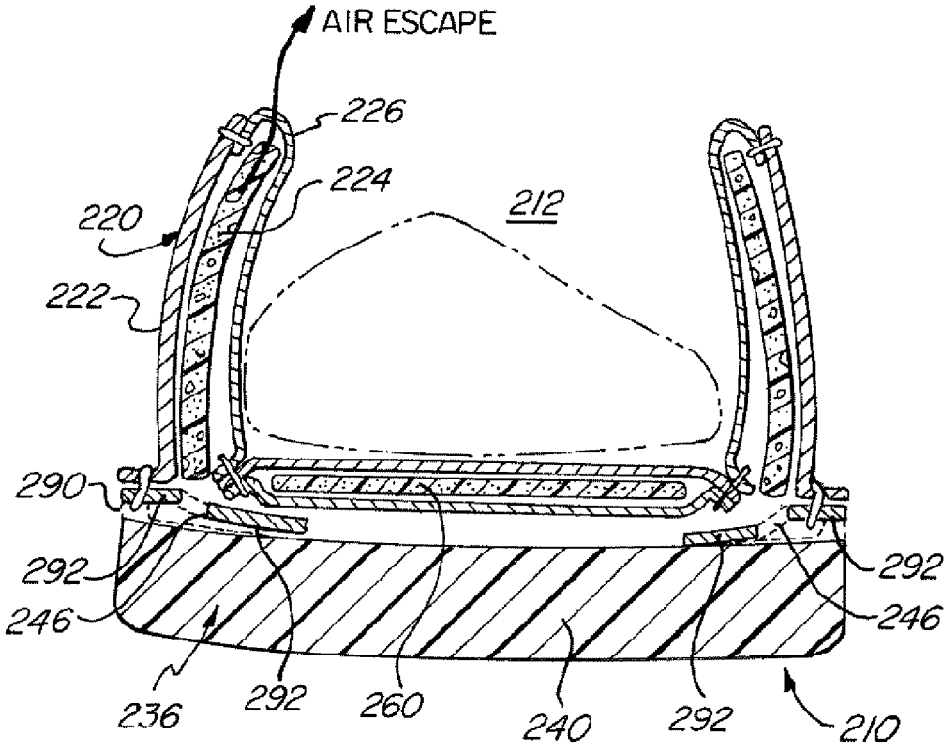
FIG. 9 is a cross section view of the vented shoe assembly of FIG. 8.

A third embodiment of the vented shoe assembly 110 is shown in FIGS. 8 and 9. The vented shoe assembly 210 includes an upper 220 and a sole 236. The upper 220 and the sole 236 are positioned together to form the vented shoe assembly 210. The upper 220 includes an outer layer 222, a porous middle layer 224, and an inner layer 226 as previously described with regard to FIGS. 1-7. The sole 236 includes an outsole 240 and an insole 260. In the embodiment shown in FIGS. 8-9, the upper 20 is positioned on an upper surface of the outsole to form a vented shoe assembly 110. The sole 236 and the upper 220 form a ventilated sole assembly 210 that draws fresh air through the sole 236 and upper 220, cooling the interior shoe cavity 212.

Referring to the embodiment shown in FIG. 9, passageways 246 are provided between the outsole 140 and the porous middle layer 224. The passageways 246 communicate with the ambient atmosphere through one or more external vent openings 290 in the outsole 240. The porous middle layer 224 vents to the exterior of the shoe either through perforations in the outer layer 22, or through the inner layer 226. Sole 236 includes an insole 260, and optionally, a resilient midsole of the types previously described. Upper 220 is affixed to sole 236 by flanges 246 which are glued or welded to the outsole 240.

The present invention provides a vented shoe assembly which incorporates air ventilation in the sole of the shoe and the upper of the shoe, which allows for air to be circulated through a layer of the upper and further allows for air to be circulated through the sole of the shoe. Ambient air is drawn into and expelled from the vented shoe assembly through one or more of external vent openings in the sole and through perforations in the outer layer of the upper. Air is circulated through the vented shoe assembly though the pumping action of the upstep/downstep motion of the shoe, or through convection as heat is transferred from the foot to the air within the vented shoe assembly.

Although the invention has been described with reference to a particular arrangement of parts, features and the like, these are not intended to exhaust all possible arrangement or features, and indeed many other modifications and variations will be ascertainable to those of skill in the art.

What is claimed is:

1. A self-ventilating shoe assembly, comprising:

an upper having an outer layer, a porous middle layer formed of a porous material, and an inner layer;

a sole including an outsole and a resilient midsole, said resilient midsole being positioned on an upper surface of said outsole, said upper being positioned on an upper surface of said resilient midsole;

one or more of said resilient midsole and said outsole having one or more external vent openings, said external vent openings being in fluid communication with one or more chambers defined by one or more of said resilient midsole and said outsole, said chambers being in fluid communication with said porous middle layer of said upper, said vent openings providing continuous fluid communication both into and out of said one or more chambers.

2. The self-ventilating shoe assembly of claim 1, wherein said upper is provided with one or more porous areas for venting said porous middle layer.

3. The self-ventilating shoe assembly of claim 2, wherein said one or more chambers are in fluid communication with said porous middle layer of said upper by one or more channels provided in one or more of said resilient midsole and said outsole.

4. The self-ventilating shoe assembly of claim 3, wherein said resilient midsole is provided with a plurality of insole cooling ports, said plurality of cooling ports being in fluid communication with said one or more chambers.

5. The self-ventilating shoe assembly of claim 4, further comprising a porous insole, said porous insole being positioned on an upper surface of said resilient midsole and above said plurality of insole cooling ports.

6. The self-ventilating shoe assembly of claim 3, wherein said one or more external vent openings are deformable by compression of one or more of said resilient midsole and said outsole causing at least partial closure of said one or more external vent openings and further causing air to be forced from said one or more chambers through said porous middle layer of said upper.

7. The self-ventilating shoe assembly of claim 3, wherein said one or more chambers extend laterally from said one or more external vent openings.

8. The self-ventilating shoe assembly of claim 7, wherein said one or more channels comprise one or more upwardly extending peripheral channels in said resilient midsole formed around a substantial portion of a perimeter of said resilient midsole.

9. The self-ventilating shoe assembly of claim 7, wherein said one or more channels extend upwardly to said resilient midsole, and extend laterally outwardly to a perimeter of said resilient midsole and upwardly therefrom to said porous middle layer of said upper.

10. The self-ventilating shoe assembly of claim 9, wherein said one or more channels are in part defined by an insole, said insole being positioned on an upper surface of said resilient midsole.

11. The self-ventilating shoe assembly of claim 10, wherein said insole is porous; said porous insole being in fluid communication with said one or more channels.

12. The self-ventilating shoe assembly of claim 9, wherein said one or more channels are defined by one or more of said insole, said resilient midsole, and said outsole.

13. A self-ventilating shoe assembly, comprising:

an upper having an outer layer, a porous middle layer formed of a porous material, and an inner layer;

a sole including a outsole, and a resilient midsole, wherein said outsole comprises a first outsole and a second outsole, said second outsole being positioned on an upper surface of said first outsole, said resilient midsole being positioned on an upper surface of said outsole, said upper being positioned on an upper surface of said resilient midsole;

said outsole having one or more external vent openings being defined by said first outsole and said second outsole, said external vent openings being in fluid communication with one or more chambers defined by one or more of said resilient midsole and said outsole, said one or more chambers being in fluid communication with said porous middle layer of said upper, said vent openings providing continuous fluid communication both into and out of said one or more chambers.

14. The self-ventilating shoe assembly of claim 13, wherein said one or more chambers are in fluid communication with said porous middle layer of said upper by one or more channels provided in one or more of said resilient midsole and said outsole.

15. The self-ventilating shoe assembly of claim 14 further comprising an insole, wherein said one or more channels is defined by one or more said outsole, said resilient midsole, and said insole.

16. The self-ventilating shoe assembly of claim 15, wherein said insole is porous.

17. The self ventilating shoe assembly of claim 16, wherein said one or more channels extend upwardly from said chamber through said resilient midsole, and extend laterally outwardly to a perimeter of said resilient midsole and upwardly therefrom to said porous middle layer of said upper.

18. The self-ventilating shoe assembly of claim 13, wherein the said one or more chambers extend laterally from said external vent openings at an angle above horizontal.

19. The self-ventilating shoe assembly of claim 14, wherein said upper is provided with one or more porous areas for venting said porous middle layer.

20. A self-ventilating shoe assembly, comprising:

an upper having an outer layer, a porous middle layer, and an inner layer;

a sole including a outsole, and a resilient midsole, and an insole, said resilient midsole being positioned on an upper surface of said outsole, said upper being positioned on an upper surface of said resilient midsole;

said outsole having one or more external vent openings being defined by said outsole, said external vent openings being in fluid communication with one or more chambers defined by one or more of said resilient midsole and said outsole said one or more chambers extending laterally from said external vent openings, said one or more chambers being in fluid communication with said porous middle layer of said upper by one or more channels provided in one or more of said resilient midsole, said outsole, and said insole;

said upper having one or more porous areas for venting said porous middle layer.

* * * * *